United States Patent [19]

Gien et al.

[11] 4,094,366

[45] June 13, 1978

[54] PNEUMATIC PERCUSSION MACHINES

[76] Inventors: Abraham Gien; Bernard Lionel Gien, both of PO Box 196, Swartruggens, Transvaal, South Africa

[21] Appl. No.: 728,027

[22] Filed: Sept. 30, 1976

[30] Foreign Application Priority Data

Oct. 2, 1975 South Africa ..... 75/6257

[51] Int. Cl.[2] ..... H01B 17/00

[52] U.S. Cl. ..... 173/138

[58] Field of Search ..... 173/135, 136, 137, 138

[56] References Cited

U.S. PATENT DOCUMENTS

| | | | |
|---|---|---|---|
| 2,810,549 | 10/1957 | Morrison | 173/138 |
| 3,164,214 | 1/1965 | Oelke | 173/138 |
| 3,480,088 | 11/1969 | Ghelfi | 173/138 |
| 3,735,820 | 5/1973 | Curington | 173/136 |
| 3,970,153 | 7/1976 | Gien et al. | 173/136 |

*Primary Examiner*—Robert A. Hafer
*Attorney, Agent, or Firm*—Haseltine, Lake & Waters

[57] ABSTRACT

A pneumatic percussion machine such as a drill having a piston reciprocating in a casing, chambers formed in the casing at or towards the ends of the piston, the arrangement permitting compressed air to be supplied alternatively to the chambers, the compressed air to the one chamber being supplied through a projecting member located co-axially in the casing, and over which the piston reciprocates, and the piston and compressed air from the other chamber being exhausted from such chamber between the wall of the casing and a stepped portion of the piston and then through the piston to atmosphere. Provision is made for the piston to move to a position, in an inoperative condition of the machine, in which both chambers are open to the atmosphere.

5 Claims, 4 Drawing Figures

PNEUMATIC PERCUSSION MACHINES

FIELD OF THE INVENTION

This invention relates to pneumatic percussion machines. Such machines include, for instance, pneumatic drills, hammers and the like.

BACKGROUND OF THE INVENTION

Generally, pneumatic percussion machines comprise a hollow steel casing or cylinder in which a piston is adapted to be reciprocated. One end of the cylinder is closed off with a valve assembly through which compressed air is supplied to the piston face while the other end is closed off with a bit assembly.

Various arrangements have been proposed for bringing about reciprocation of the piston in the casing. One such arrangement is described in the complete specification to our South African patent application No. 73/7904. In the preferred form of the arrangement described in such complete specification there is provided a projecting member which extends from the valve assembly through the hollow steel casing into a bore provided in the piston. Such projecting member includes longitudinally extending two paths, one path being adapted to introduce compressed air from the valve assembly through the piston to a chamber located at or towards the lower end of the piston. The other path extends from a chamber formed between the top of the piston and the valve assembly, to the bore of the piston, the arrangement being such that for particular positions of the piston relative to the hollow steel casing, air is discharged from this chamber through the projecting member into the bore of the piston from where it can escape to the atmosphere.

In the case of the abovementioned pneumatic percussion machine, there are therefore two paths that pass through the projecting member, one path being intended for introducing compressed air to one of the chambers and the other path being intended for exhausting air from the other chamber to the atmosphere. While no difficulty is encountered, from the engineering point of view, in providing a projecting member having two passages, it is believed that by eliminating one of the passages in the projecting member, the cost of manufacturing such pneumatic percussion machine can be lowered.

An object of the present invention is the provision of a pneumatic percussion machine in which the need for two longitudinally passages in the projecting member is dispensed with.

SUMMARY OF THE INVENTION

According to the invention, a pneumatic percussion machine includes:

a hollow casing;

a valve assembly at one end of the casing;

a bit assembly at the other end of the casing;

a piston adapted to reciprocate in the casing between a first position in which it is in contact with the bit assembly and a second position in which it is removed from such first position;

a first chamber formed between an end of the piston and the valve assembly;

a second chamber formed at or towards the other end of the piston;

a first fluid supply path through the valve assembly to the first chamber;

a second fluid supply path through the valve assembly to the second chamber, such second fluid supply path passing, for at least part of its length through the piston; and a first fluid discharge path from the first chamber passing, for at least part of its length, between the wall of the casing and the piston, such fluid discharge path being open in particular positions of the piston along the length of the hollow casing;

the arrangement being one in which the valve assembly is adapted, on operation of the machine, to open alternately the fluid supply paths.

Preferably, the piston is adapted to reciprocate along a projecting member through which the second fluid path passes from the valve assembly to the piston. The projecting member may be located substantially axially with respect to the casing and may be received in an axially disposed bore provided in the piston.

Further according to the invention, the first fluid discharge path extends for part of its length between the piston and the wall of the casing and for the remainder of its length along a duct provided in the piston. Preferably, the piston is stepped for part of its length to provide the passage between the piston and the wall of the casing.

The valve assembly may include a clapper valve. Such clapper valve may be adapted, during operation of the machine, to open the first fluid supply path for at least part of the movement of the piston from its second position to its first position and to open the second fluid supply path for at least part of the movement of the piston from its second position to its first position.

The piston may be adapted to move to a third position in which it is adjacent the bit assembly and in which the bit assembly is located in a non-operative position. In this third position of the piston, the first and second fluid supply paths as well as the first fluid discharge path are open to the atmosphere.

The invention is also directed towards a piston adapted for use with a pneumatic percussion machine, including a cylinder having a first bore extending inwards from an end face of the piston, for part of the axial length of the piston, a second bore extending inwards from the other end face of the piston, for part of the axial length of the piston, the piston having a first stepped section extending around its periphery, such stepped section being located at a point radially outwards from the first bore of the piston, a second stepped section extending about the periphery of the piston, such stepped section being located at a point extending radially from the second bore of the piston, at least one fluid path extending from the first stepped section of the piston to the second bore, and at least one further fluid path extending from the second stepped section to the first bore.

A further aspect of the invention is the provision of a projecting member, adapted for use in a pneumatic percussion machine, such projecting member comprising a hollow tubular section which is closed at one end, a hole extending radially inwards to meet the bore towards the closed end of the tubular section and a radially extending flange located at or towards the closed end of the tubular section.

Another aspect of the invention is concerned with a method for reciprocating a piston of a pneumatic percussion machine, including the steps of providing a chamber at or towards each end of the casing, locating a piston in such casing with a piston face thereof operating in each of such chambers, and introducing compressed air alternately into the chambers to cause reciprocation of the piston between the chambers, the compressed air being introduced to one chamber through a duct formed in the piston and exhausted from the other chamber through a passage extending for part of its length, between the casing wall and the piston.

Preferably, the compressed air passed through the duct in the piston is also passed through a duct formed in a projecting member located in the casing.

DESCRIPTION OF DRAWINGS

By way of example only, preferred forms of the invention will now be described with reference to the accompanying drawings, in which.

DESCRIPTION OF ILLUSTRATED EMBODIMENTS

Figure 1:
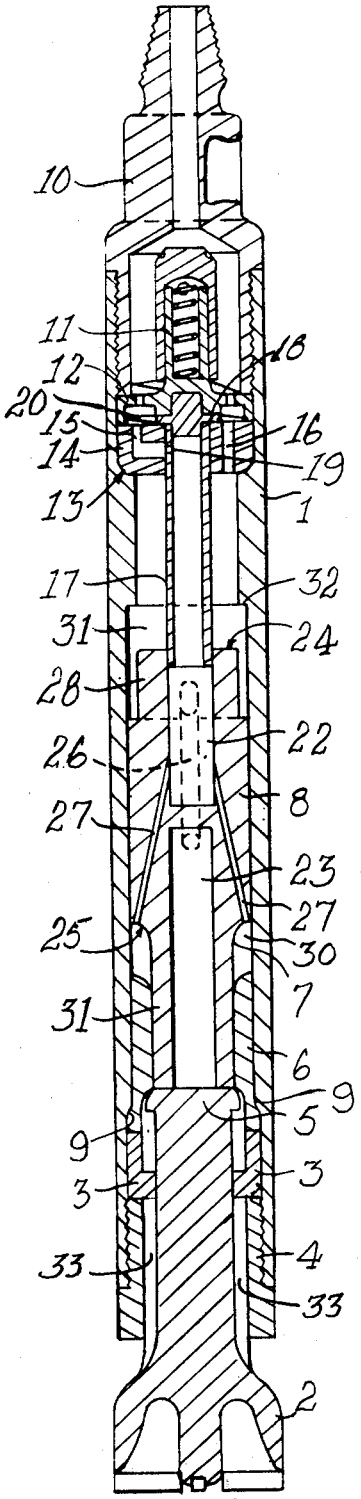
FIG. 1 is a section through one form of the pneumatic percussion drill with a bit assembly of such drill in its operative position, and the piston in contact with such bit assembly.
Figure 2:
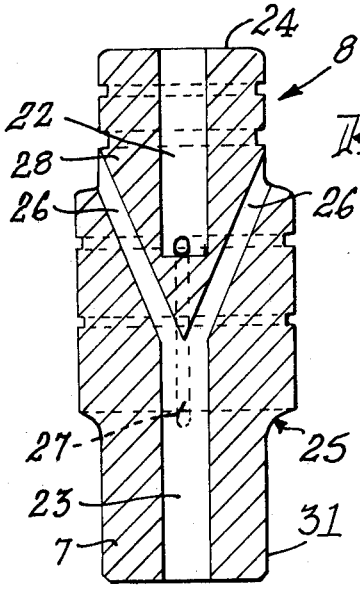
FIG. 2 is a section through the axis of the piston of FIG. 1.
Figure 3:
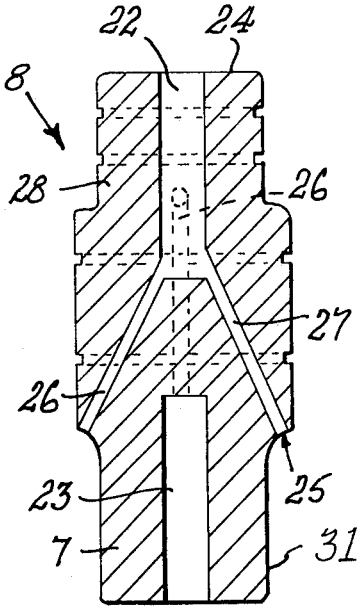
FIG. 3 is a section at right angles to the section of FIG. 2 and through the axis of the piston.

The pneumatic percussion drill shown in FIGS. 1 to 3 comprises a hollow casing 1 which is internally tapped at both its extremities. At one end of the casing there is fitted a bit assembly. In the form of the invention shown in the accompanying drawings, such bit assembly includes a bit 2, withdrawal of which is prevented by two retaining half rings 3. These half rings are held in position by a threaded chuck 4 that engages in a tapped end portion of the casing 1. The upper end of the bit is formed into a suitable striking head 5.

The bit assembly also includes a stem bearing 6, which provides a guide for a stepped portion 7 of the piston 8. As will be seen from the accompanying drawings, the stem bearing 6 is stepped to bear against a complementary internal step 9 in the casing as the chuck 4 is tightened.

The other end of the casing 1 is fitted with a back head 10 which engages the casing end in a screw fit. The back head is fitted with a spring-biased check valve 11 located about a projecting stem of the valve chest 12. The check valve 11 is adapted automatically to close off the drill interior during non-operation of the drill.

The casing is stepped internally, at the end thereof fitted with the back head assembly, such step 13 being provided at a point inwardly from the tapped section of the casing end. Against such step 13 there bears a valve seat 14 having two ducts 15 and 16 passing through it.

The valve seat 14 is fitted with a projecting member 17 which passes through a hole provided in the seat to extend into the confines of the casing. A peripheral flange 18 is provided towards one end of the projecting member so that on tightening the back head 10 in the casing end, the projecting member 17 is held tight by the valve chest 12 against the valve seat 14 while the valve seat 14 is pressed firmly against the step 13 of the casing.

The projecting member 17 comprises a tubular section, closed at one end which has a bore that extends from one end thereof along the length towards the closed end. A hole 19 is drilled through the wall of the projecting member 17 at a position in proximity to the inner end of the bore. This hole 19 lines up with the duct 15 in the valve seat 14 and provides communication between such duct and the interior of the projecting member 17.

The ducts 15, 16 in the valve seat are opened alternately by a conventional clapper valve arrangement 20 pivotally mounted on an end of the projecting member 17 and constituting, with the valve seat 14, a valve assembly.

The casing is fitted with a piston 8 provided with axial bores 22, 23 which extend inwardly from the end face of the piston, the length of the bores being such that they do not meet. The piston has two stepped sections 28, 29 which are positioned radially with respect to the bores 22, 23 of the piston.

The casing is further stepped at 32 to provide a wider bore in which the piston oscillates.

In FIG. 1 of the accompanying drawings, the piston 8 is shown in contact with the striking head 5 of the bit 2. The clapper valve 20 is shown in position with the duct 15 open. In this position of the valve, compressed air passes in through the back head 10 into the duct 15, from there into the interior of the projecting member 17. From the projecting member the compressed air passes down the bore 22, duct 27 in the piston 8 and then into the second chamber 30.

As a result, the piston is forced up towards the valve assembly. Once the piston has moved sufficiently far for the stepped section 7 of the piston 8 to move out from the stem bearing 6, air escapes from the second chamber 30 along passages 33 past the bit assembly to atmosphere. At this stage, there is a sudden increase in flow of compressed air through passage 15 causing the clapper valve 20 to flip over to a position in which it closes off duct 15 and opens duct 16. Compressed air is now introduced through duct 16 into the first chamber 29 as a result of which the piston is forced down towards the bit assembly to a stage where the piston end strikes the striking head 5 of bit 2. At this point, air in the second chamber 30 is free to pass through the passage formed between the inner wall of casing 1 and the side of piston 8 into the duct 26 from where it can escape down passage 23 past the bit assembly to atmosphere. As a result, an increase in flow of compressed air through duct 16 takes place causing the clapper valve 20 back to close off duct 16 and open duct 15, thereby feeding air through to the second chamber in the manner described above. In this way, the reciprocating cycle of the piston is set up.

During non-operative periods of the drill, the drill is raised off the drill bit to cause the striking head of the drill bit to drop onto the half rings 3. In this position of the drill, the projecting member 17 is withdrawn from the bore of the piston and air can either pass through duct 16 to the first chamber and then through duct 26 and bore 23 to the atmosphere or through duct 15 into the interior of the projecting member and from there to the second chamber from where it passes along duct 27 and bore 22 to the first chamber and then through duct 26 and bore 23 to atmosphere.

Figure 4:
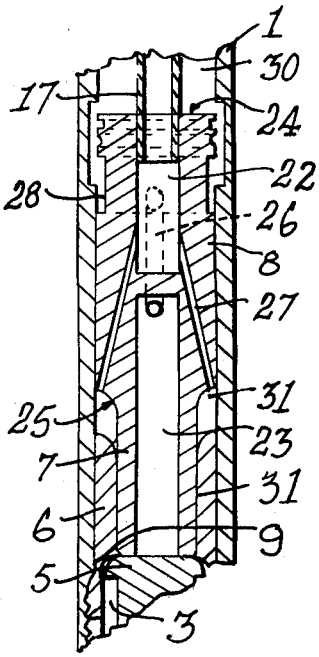
FIG. 4 is a section through part of a second form of the pneumatic percussion machine.

A second form of the invention is shown in FIG. 4. In this form of the invention the step of the piston does not extend to the extremity of the piston but is in the form of a radially extending recess. The piston operates as described above.

Other forms of the invention exist. The striking head and the bit head may be separate members.

In this latter instance, the striking head and the bit head may interlock releasibly for easy replacement of the bit. The bit head need not therefore form part of the bit assembly. The term "bit assembly" must therefore be interpretted in the sense in which it may or may not include a bit head.

The invention incorporates many advantages. It comprises a minimum number of working parts, thereby lessening the effect of wear. By eliminating the inner sleeve of a sliding valve employed in some conventional machines, a piston of larger diameter, for the same overall diameter of the machine, can be obtained. This in turn allows for a machine having a larger piston face and permits the machine to operate at lower fluid pressure than would normally be the case.

The machine also has the advantage that when it is raised to lift the bit off the work face, the fluid exhaust path is automatically opened to allow compressed air to escape to the atmosphere and thereby stop reciprocation of the piston in the casing.

By virtue of the increased diameter, and hence, mass of the piston, there is an increase in the intensity of the blow imparted by the piston to the striking head. The impact of the blow is also transmitted directly to the bit head.

At the same time, the extra cost of providing two longitudinally extending passages in the projecting member is done away with leading to a reduction in manufacturing costs.

We claim:

1. A pneumatic percussion machine including:
a hollow casing;
a valve assembly at one end of the casing;
a bit assembly at the other end of the casing;
a piston for reciprocation in the casing between a first position in which it is in contact with the bit assembly and a second position in which it is removed from such first position, the piston being stepped along its length;
a first chamber formed between an end of the piston and the valve assembly;
a second chamber formed inwardly from the other end of the piston about such stepped portion of the piston;
a first fluid supply path through the valve assembly to the first chamber;
a second fluid supply path through the valve assembly to the second chamber, such second fluid supply path passing, for at least part of its length through the piston;
a first fluid discharge path from the first chamber passing between the wall of the casing and the piston and then through the piston, such fluid discharge path being open in particular positions of the piston along the length of the hollow casing;
the arrangement being one in which the valve assembly is adapted, on operation of the machine, to open alternately the fluid supply paths.

2. A pneumatic percussion machine as claimed in claim 1 in which the piston is adapted to move to a third position in which the first and second fluid paths and the first fluid discharge path, are open to the atmosphere.

3. A pneumatic percussion machine as claimed in claim 1 in which the stepped portion of the piston is received in a stem bearing for forming the second chamber between the steps in the piston and the stem bearing.

4. A pneumatic percussion machine including:
a hollow casing;
a valve assembly at one end of the casing;
a bit assembly at the other end of the casing;
a piston for reciprocation in the casing between a first position in which it is in contact with the bit assembly and a second position in which it is removed from such first position, the piston being stepped along its length;
a first chamber formed between an end of the piston and the valve assembly;
a second chamber formed inwardly from the end of the piston between the piston step and a stem bearing in which the stepped portion of the piston is received;
a first fluid supply path through the valve assembly to the first chamber;
a second fluid supply path through the valve assembly to the second chamber, such second fluid supply path passing, for at least part of its length through the piston;
a first fluid discharge path from the first chamber passing, for at least part of its length, between the wall of the casing and the piston and for the remainder of its length through the piston, such fluid discharge path being open in particular positions of the piston along the length of the hollow casing;
the arrangement being one in which the valve assembly is adapted, on operation of the machine, to open alternately, the fluid supply paths.

5. A piston adapted for use with a pneumatic percussion machine including a cylinder having a first bore extending inwards from an end face of the piston, for part of the axial length of the piston, a second bore extending inwards from the other end face of the piston, for part of the axial length of the piston, such first and second bores not communicating with each other, the piston having a first outer stepped portion, such stepped portion being located at a point radially outwards from the first bore of the piston, a second outer stepped portion, such outer stepped portion being located at a point extending radially outwards from the second bore of the piston, at least one fluid path extending from the first stepped portion of the piston to the second bore and at least one fluid path extending from the second stepped portion to the first bore.

* * * * *